US008135593B2

(12) United States Patent
Miao et al.

(10) Patent No.: US 8,135,593 B2
(45) Date of Patent: Mar. 13, 2012

(54) METHODS, APPARATUSES AND SYSTEM FOR ENCODING AND DECODING SIGNAL

(75) Inventors: Lei Miao, Shenzhen (CN); Zexin Liu, Shenzhen (CN); Longyin Chen, Shenzhen (CN); Chen Hu, Shenzhen (CN); Wei Xiao, Shenzhen (CN); Herve Marcel Taddei, Voorburg (NL); Qing Zhang, Shenzhen (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 0 days.

(21) Appl. No.: 13/100,091

(22) Filed: May 3, 2011

(65) Prior Publication Data

US 2011/0194598 A1 Aug. 11, 2011

Related U.S. Application Data

(63) Continuation of application No. PCT/CN2009/075053, filed on Nov. 20, 2009.

(30) Foreign Application Priority Data

Dec. 10, 2008 (CN) ..... 2008 1 0239451

(51) Int. Cl.

| | |
|---|---|
| ***G10L 19/14*** | (2006.01) |
| ***G10L 11/04*** | (2006.01) |
| ***G10L 19/00*** | (2006.01) |
| ***G10L 21/04*** | (2006.01) |

(52) U.S. Cl. ..... 704/501; 704/205; 704/206; 704/229; 704/503

(58) Field of Classification Search ..... 704/501, 704/503, 229, 205, 206

See application file for complete search history.

(56) References Cited

U.S. PATENT DOCUMENTS

| | | | | |
|---|---|---|---|---|
| 6,098,039 | A * | 8/2000 | Nishida | 704/229 |
| 6,226,608 | B1 * | 5/2001 | Fielder et al. | 704/229 |
| 6,266,644 | B1 * | 7/2001 | Levine et al. | 704/503 |
| 6,615,169 | B1 * | 9/2003 | Ojala et al. | 704/205 |
| 6,959,274 | B1 * | 10/2005 | Gao et al. | 704/219 |
| 6,978,236 | B1 * | 12/2005 | Liljeryd et al. | 704/219 |
| 7,246,065 | B2 | 7/2007 | Tanaka et al. | |
| 2004/0181403 | A1 * | 9/2004 | Hsu | 704/230 |
| 2007/0038439 | A1 * | 2/2007 | Schuijers et al. | 704/212 |
| 2007/0078646 | A1 | 4/2007 | Lei et al. | |
| 2007/0174051 | A1 | 7/2007 | Oh et al. | |
| 2007/0299656 | A1 | 12/2007 | Son et al. | |
| 2008/0027717 | A1 * | 1/2008 | Rajendran et al. | 704/210 |

(Continued)

FOREIGN PATENT DOCUMENTS

| | | | |
|---|---|---|---|
| CN | 1498396 | A | 5/2004 |

(Continued)

*Primary Examiner* — Paras Shah

(74) *Attorney, Agent, or Firm* — Slater & Matsil, L.L.P.

(57) ABSTRACT

Methods and apparatuses for encoding a signal and decoding a signal and a system for encoding and decoding are provided. The method for encoding a signal includes performing a classification decision process on high frequency signals of input signals, adaptively encoding the high frequency signals according to the result of the classification decision process, and outputting a bitstream including codes of low frequency signals of the input signals, adaptive codes of the high frequency signals, and the result of the classification decision process. The classification decision process is performed on the high frequency signals, and adaptive encoding or adaptive decoding is performed according to the result of the classification decision process, so the quality of voice and audio output signals is improved.

12 Claims, 8 Drawing Sheets

U.S. PATENT DOCUMENTS

| | | | | |
|---|---|---|---|---|
| 2008/0097751 | A1 | 4/2008 | Tsuchinaga et al. | |
| 2008/0221905 | A1 * | 9/2008 | Schnell et al. | 704/500 |

FOREIGN PATENT DOCUMENTS

| | | | |
|---|---|---|---|
| CN | 1945695 | A | 4/2007 |
| CN | 101061535 | A | 10/2007 |
| EP | 1 916 652 | B1 | 10/2010 |
| WO | WO 03/065353 | A1 | 8/2003 |
| WO | WO 2007/086646 | A1 | 8/2007 |
| WO | WO 2007/142434 | A1 | 12/2007 |
| WO | WO 2007/148925 | A1 | 12/2007 |

* cited by examiner

METHODS, APPARATUSES AND SYSTEM FOR ENCODING AND DECODING SIGNAL

This application is a continuation of co-pending International Application No. PCT/CN2009/075053, filed on Nov. 20, 2009, which claims priority to Chinese Patent Application No. 200810239451.5, filed on Dec. 10, 2008, both of which applications are incorporated herein by reference in their entireties.

TECHNICAL FIELD

The present invention relates to the field of voice and audio encoding and decoding, and in particular, to methods and apparatuses for encoding a signal and decoding a signal, and a system for encoding and decoding.

BACKGROUND

In the voice and audio encoding algorithm, because of limitations of human auditory characteristics and a bit rate, low frequency signals are usually preferentially encoded. With the development of networks, limitation for bandwidth becomes smaller and smaller, and people have higher requirements for sound quality. The sound quality of signals can be improved by increasing bandwidth of signals, and when no or a few bits exist, a bandwidth expansion technology may be adopted. As a technology of expanding a band range of voice signals and improving the quality of signals, the bandwidth expansion technology has developed remarkably in recent years and realizes commercial application in several fields, in which a bandwidth expansion algorithm in G. 729.1 and the Spectral Band Replication (SBR) technology in the Motion Picture Expert Group (MPEG) are two widely used bandwidth expansion technologies.

In the bandwidth expansion technology provided in the prior art, one method is as follows. At an encoding end, high frequency signals are not encoded, and an encoding algorithm of low frequency signals in an encoder is not changed. At a decoding end, the high frequency signals are blindly expanded according to the low frequency signals obtained by decoding and a potential relation between the high and low frequencies. In this method, as no relevant information of the high frequency signals may be referred to at the decoding end, the quality of the expanded high frequency signals is poor.

The other method is as follows. At the encoding end, information of some time envelopes and spectral envelopes of high frequency signals are encoded. At the decoding end, an excitation signal is generated according to spectral information of the low frequency signals, and the high frequency signals are recovered combining the excitation signal and the information of time envelopes and spectral envelopes of the high frequency signals obtained through decoding. Compared with the foregoing method, this method helps better the quality of the expanded high frequency signals, but for some harmonic intense signals, large distortion may easily occur; therefore, the quality of output voice and audio signals in this method also needs to be improved.

SUMMARY OF THE INVENTION

The present invention is directed to methods and apparatuses for encoding a signal and decoding a signal, and a system for encoding and decoding, so as to improve the quality of voice and audio output signals.

An embodiment of the present invention provides a method for encoding a signal, where the method includes performing a classification decision process on high frequency signals of input signals. The high frequency signals are adaptively encoded according to the result of the classification decision process. An encoded bitstream of low frequency signals, an adaptive encoded bitstream of the high frequency signals, and the result of the classification decision process are output.

An embodiment of the present invention provides a method for decoding a signal, where the method includes receiving an encoded bitstream including codes of low frequency signals, an adaptive encoded bitstream of high frequency signals, and a result of a classification decision process of the high frequency band signals. The high frequency signals are adaptively decoded according to the result of the classification decision process and a determined excitation signal. The low frequency signals are decoded and output signals including the decoded low frequency signals and the adaptively decoded high frequency signals are obtained.

An embodiment of the present invention provides an apparatus for encoding a signal, where the apparatus includes a code classification module adapted to perform a classification decision process on high frequency signals of input signals. An adaptive encoding module is adapted to adaptively encode the high frequency signals according to the result of the classification decision process. A bitstream output module is adapted to output a bitstream including codes of low frequency signals of the input signals, adaptive codes of the high frequency signals, and the result of the classification decision process.

An embodiment of the present invention provides an apparatus for decoding a signal, where the apparatus includes a receiving module adapted to receive a bitstream including codes of low frequency signals, adaptive codes of high frequency signals, and a result of a classification decision process. An adaptive decoding module is adapted to adaptively decode the high frequency signals according to the result of the classification decision process and a determined excitation signal. A low frequency signal encoding module is adapted to decode the low frequency signals. A signal obtaining module is adapted to obtain output signals including the decoded low frequency signals and the adaptively decoded high frequency signals.

An embodiment of the present invention provides a system for encoding and decoding, where the system includes a signal encoding apparatus adapted to perform a classification decision process on high frequency signals of input signals, to adaptively encode the high frequency signals according to the result of the classification decision process, and to output a bitstream including codes of low frequency signals of the input signals, adaptive codes of the high frequency signals, and the result of the classification decision process; and a signal decoding apparatus adapted to receive the bitstream including the codes of the low frequency signals of the input signals, the adaptive codes of the high frequency signals, and the result of the classification decision process, to adaptively decode the high frequency signals according to the result of the classification decision process and a determined excitation signal, to decode the low frequency signals, and to obtain output signals including the decoded low frequency signals and the adaptively decoded high frequency signals.

According to the embodiments of the present invention, the classification decision process is performed on the high frequency signals, and adaptive encoding or adaptive decoding is performed according to the result of the classification decision process. Therefore, the quality of voice and audio output signals is improved.

DETAILED DESCRIPTION OF ILLUSTRATIVE EMBODIMENTS

The technical solutions of the present invention are further described in detail with reference to the accompanying drawings and the following embodiments.

Figure 1:
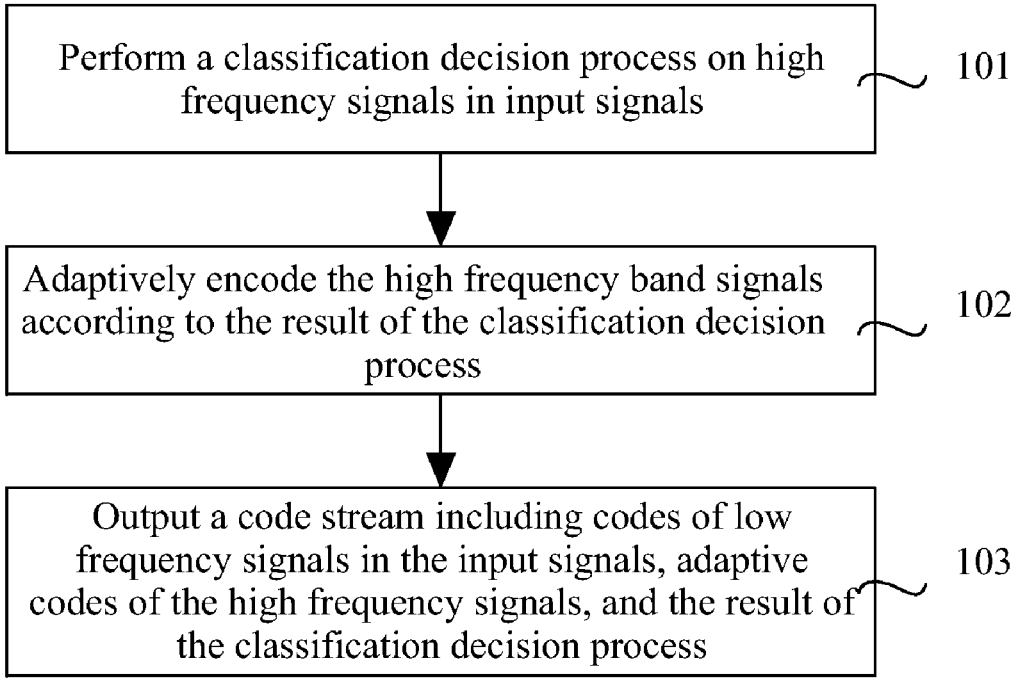
FIG. 1 is a flow chart of a method for encoding a signal according to Embodiment 1 of the present invention.

FIG. 1 is a flow chart of a method for encoding a signal according to Embodiment 1 of the present invention. As shown in FIG. 1, the method specifically includes the following steps.

In Step 101, a classification decision process is performed on high frequency signals of input signals.

In Step 102, the high frequency signals are adaptively encoded according to the result of the classification decision process.

In Step 103, a bitstream including the encoded bitstream of low frequency signals, the adaptive encoded bitstream of the high frequency signals, and the result of the classification decision process is output.

According to Embodiment 1, the classification decision process is performed on the high frequency signals, and adaptive encoding is performed according to the result of the classification decision process. In this way, the adaptive encoding is performed on signals of different types, so the quality of voice and audio output signals is improved.

Figure 2:
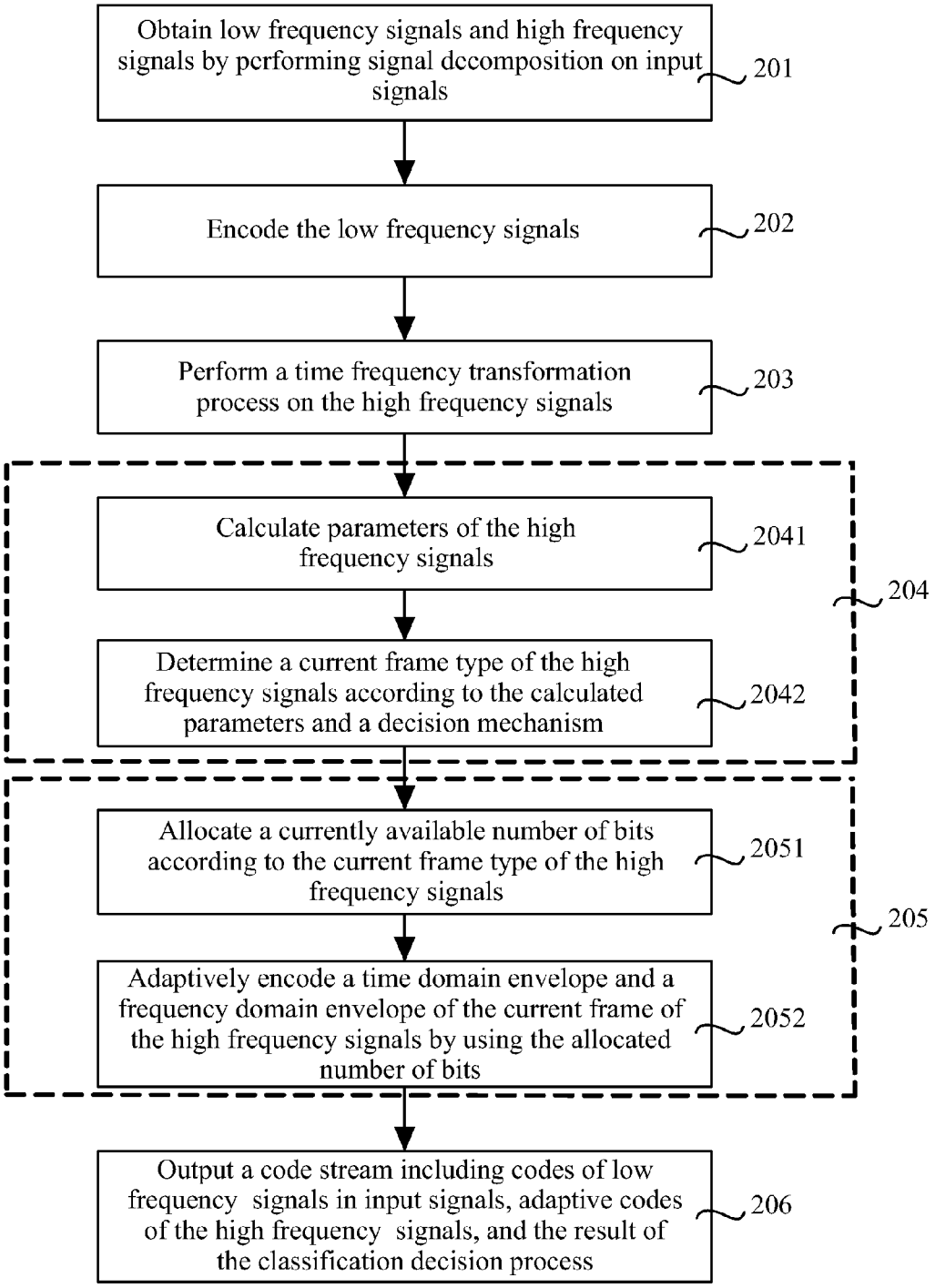
FIG. 2 is a flow chart of a method for encoding a signal according to Embodiment 2 of the present invention.

FIG. 2 is a flow chart of a method for encoding a signal according to Embodiment 2 of the present invention. As shown in FIG. 2, Embodiment 2 specifically includes the following steps.

In Step 201, signal decomposition is performed on input signals to obtain low frequency signals and high frequency signals.

In Step 202, the low frequency signals are encoded. The sequence for performing Step 202 and Steps 203 to 205 is not limited in Embodiment 2.

In Step 203, a time frequency transformation process is performed on the high frequency signals.

In Step 204, a classification decision process is performed on the high frequency signals after the time frequency transformation. The classification decision process may determine a type of the high frequency signals. The types of the high frequency signals specifically include a transient signal and a non-transient signal, in which the non-transient signal further includes a harmonic signal, a noise-like signal, and an ordinary signal.

Furthermore, Step 204 may include the following steps.

In Step 2041, parameters of the high frequency signals are calculated.

Specifically, a current frame of the high frequency signal is captured and input into a signal analysis module. The signal analysis module is adapted to calculate parameters which include parameters required by classification and parameters required by encoding. Examples include parameters requiring calculation to determine the transient signal, such as a time domain envelope and a maximum value obtained by a next time domain envelope minus a previous one of two consecutive time domain envelopes; and parameters requiring calculation to determine the harmonic signal, such as global frequency spectrum energy, frequency domain envelope energy, and subband harmonic intensity.

In Step 2042, a current frame type of the high frequency signals is determined according to the calculated parameters and a decision mechanism.

Specifically, the types of signals are determined according to the parameters obtained by the signal analysis module and the decision mechanism. The decision mechanism may be dynamically adjusted according to a previous frame type of the high frequency signals and a weighted value of several previous frame types. For example, when the transient signal is determined, various parameters of time require comprehensive judgment, and the judgment of whether the previous frame is a transient signal is also required; and when the harmonic signal is determined, a decision threshold value requires dynamic adjustment according to the previous frame type, and the type of signal of the current frame is required to be determined according to the weighted value of the several previous frame types.

In Step 205, adaptively encode the high frequency signals according to the result of the classification decision process, in which the result indicates the current frame type of the high frequency band signals.

Furthermore, Step 205 may include the following steps.

In Step 2051, a currently available number of bits are allocated according to the current frame type of the high frequency signals, where B represents the currently available bits, that is, the bits to be allocated.

In Step 2052, adaptively encode time envelopes and spectral envelopes of the current frame of the high frequency signals by using the allocated bits.

Figure 3:
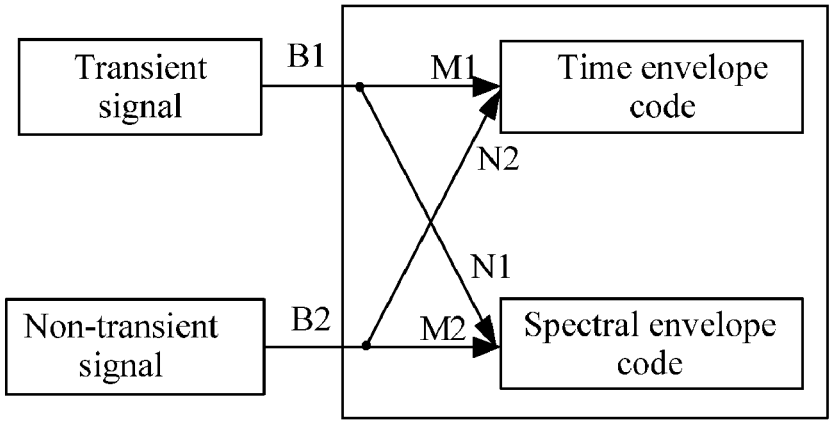
FIG. 3 is a schematic diagram of adaptive encoding in a method for encoding a signal according to Embodiment 2 of the present invention.

FIG. 3 is a schematic diagram of adaptive encoding in a method for encoding a signal according to Embodiment 2 of the present invention. Specifically, as shown in FIG. 3, at an encoding end, according to different signal types of current frames obtained through the foregoing classification algorithm, the time envelopes and the spectral envelopes of the current frame are adaptively encoded by using different bit allocation methods. As for the transient signal, as the spectral signal is relatively stable, the time signal changes sharply, so the time signal is more important, and a larger number of bits are used for encoding the time signal. As for the non-transient signal, the time signal is relatively stable, and the spectral signal changes fast, so the spectral signal is more important, and a larger number of bits are used for encoding the spectral signal.

It is assumed that the current frame type of the high frequency signals is a transient signal, where B1 represents all bits occupied by the transient signal, M1 represents bits occupied by the time envelope of the transient signal, N1 represents the bits occupied by the spectral envelope of the transient signal, B1=M1+N1, where M1 is greater than or equal to N1. That is to say, for the transient signal, a larger number of bits are used for encoding the time envelope.

It is assumed that the current frame type of the high frequency signals is a non-transient signal, where B2 represents all bits occupied by the non-transient signal, M2 represents bits occupied by the spectral envelope of the non-transient signal, N2 represents bits occupied by the time envelope of the non-transient signal, B2=M2+N2, where M2 is greater than or equal to N2, and in a condition of shorter frame length, N2 may be 0. That is to say, for the non-transient signal, a larger number of bits are used for encoding the spectral envelopes.

Furthermore, an implementation is B=B1=B2, that is, currently available bits are all used for encoding the time envelope and/or the spectral envelope. The other implementation is B≧B1, B≧B2, and B1 and B2 may be unequal, that is, remaining bits may exist, and the remaining bits equal a difference between B and B1 or B and B2. The difference between B and B1 may be used for performing fine quantizing encoding on the time envelope and/or the spectral envelope of the transient signal, or used for performing the fine quantizing encoding on the low frequency signals; and the difference between B and B2 is used for performing fine quantizing encoding on the spectral envelope and/or the time envelope of the non-transient signals, or used for performing the fine quantizing encoding on the low frequency signals.

Values of M1 and N1, or M2 and N2, may be preset, and do not need to be transmitted through codes, that is to say, when the current frame type of the high frequency signals is obtained, the currently available bits are allocated according to the preset bit values, and both the encoding end and the decoding end use the preset values. The values of M1 and/or N1 or the values of M2 and/or N2 are added in the bitstream, for example, the value of M1 is transmitted in the bitstream, and the value of B1 is known at the encoding end and the decoding end, so the value of N1 may be obtained through B1−M1 at the decoding end.

In Step 206, a bitstream including an encoded bitstream of the low frequency signals, an adaptive encoded bitstream of the high frequency signals, and the result of the classification decision process is output.

In Embodiment 2, as for different types of high frequency signals, different emphasis is placed in the encoding of the time envelope and spectral envelope, so the quality of output signals is better. Furthermore, the final signal type of the current frame is determined according to parameters of the current frame and the signal type of the previous frame at the encoding end, so the determination process is more accurate.

Figure 4:
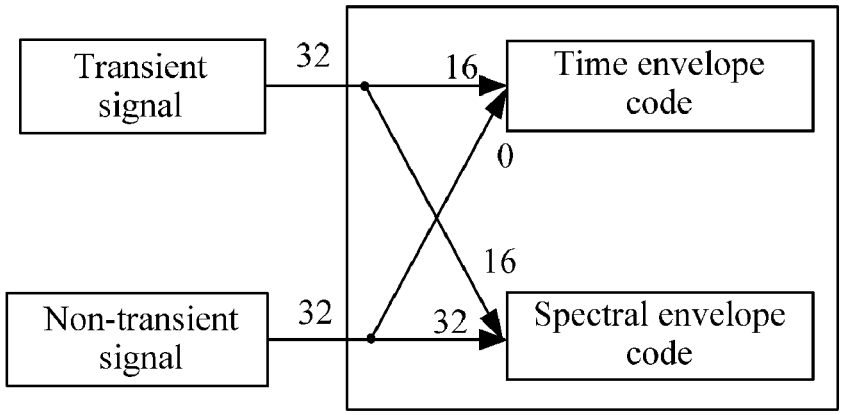
FIG. 4 is a schematic diagram of adaptive encoding in a method for encoding a signal according to Embodiment 3 of the present invention.

According to Embodiment 3 of the present invention, in the method for encoding a signal, input ultra wide band signals are decomposed to obtain the low frequency signals (wideband signals) having a frequency between 0 kHz to 8 kHz and high frequency signals having a frequency between 8 kHz to 14 kHz. The low frequency signals are encoded by using a G. 722 encoder, and a time frequency transformation process is performed on the high frequency signals, and the classification decision process is then performed. The high frequency signals include the following: the transient signal, the harmonic signal, the noise-like signal, and the ordinary signal, and the harmonic signal, the noise-like signal, and the ordinary signal are collectively called the non-transient signal, and the classification decision process may be referred to as in Embodiment 2. For the input signals, a framing process is performed according to one frame every 5 ms. FIG. 4 is a schematic diagram of adaptive encoding in a method for encoding a signal according to Embodiment 3 of the present invention. As shown in FIG. 4, in Embodiment 3, B=B1=B2=32 bits, for the transient signal, four time envelopes are encoded by using M1=16 bits, and four spectral envelopes are encoded by using N1=16 bits; for the non-transient signal, eight spectral envelopes are encoded by using M2=32 bits. As the frame length is 5 ms which is relatively short, no time envelope is encoded, that is, N2=0. Finally, the bitstream including codes of the low frequency signals of the input signals, the adaptive codes of the high frequency signals, and the result of the classification decision process is output.

In Embodiment 3, in the condition of B=B1=B2, according to different types of signals, the available bits are allocated and are respectively used for encoding the spectral envelope and the time envelope. In this way, characteristics of input signals are comprehensively considered, an effect of optimizing codes is achieved, and the quality of output signals is improved.

Figure 5:
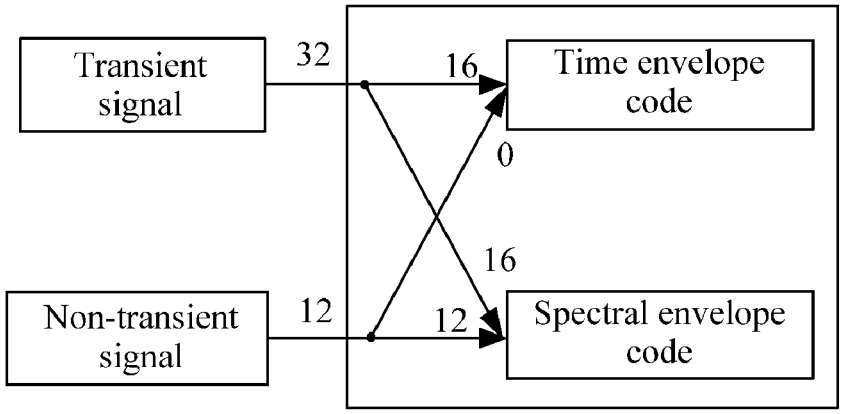
FIG. 5 is a schematic diagram of adaptive encoding in a method for encoding a signal according to Embodiment 4 of the present invention.

FIG. 5 is a schematic diagram of adaptive encoding in a method for encoding a signal according to Embodiment 4 of the present invention. As shown in FIG. 5, a difference between Embodiment 4 and Embodiment 3 lies in that B=B1>B2, B1 is unequal to B2, where B1=32 and B2=12. For a transient signal, four time envelopes are encoded by using M1=16 bits, and four spectral envelopes are encoded by using N1=16 bits; for a non-transient signal, the spectral envelope is encoded by using a vector quantization method, and eight spectral envelopes are encoded by using M2=12 bits. As the frame length is 5 ms which is relatively short, the time envelope is not encoded, that is, N2=0. In Embodiment 4, the non-transient signal is encoded by using a smaller number of bits, and the remaining bits are used for strengthening the quality of the G. 722 core encoder, that is, fine quantizing encoding is performed on the low frequency signals.

Figure 6:
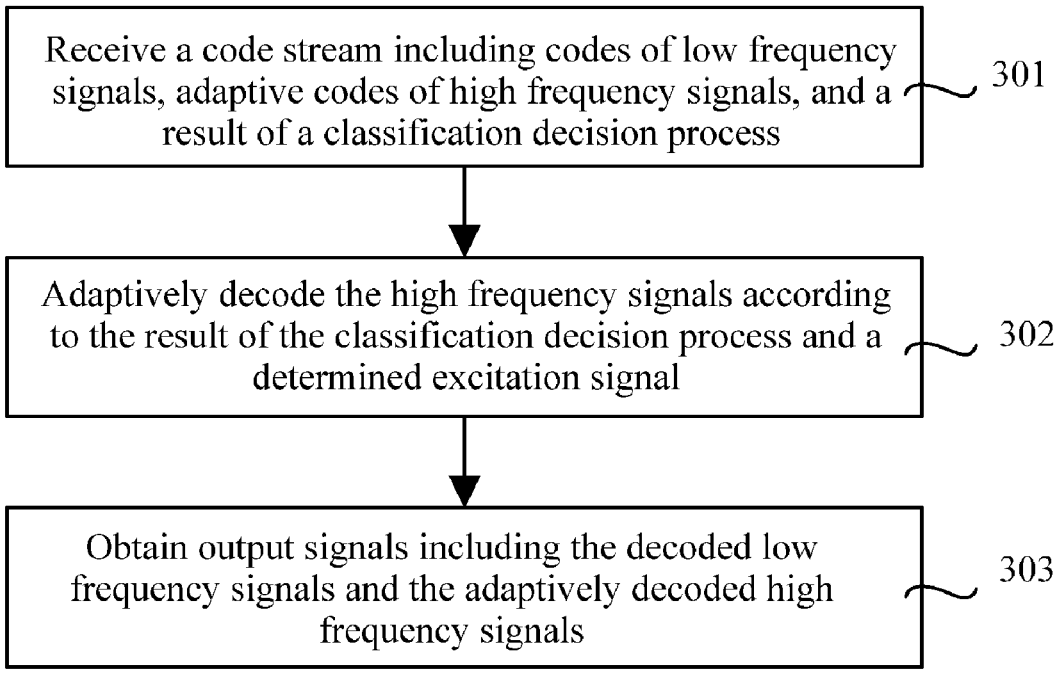
FIG. 6 is a flow chart of a method for decoding a signal according to Embodiment 1 of the present invention.

FIG. 6 is a flow chart of a method for decoding a signal according to Embodiment 1 of the present invention. As shown in FIG. 6, Embodiment 1 specifically includes the following steps.

In Step 301, a bitstream including an encoded bitstream of low frequency signals, an adaptive encoded bitstream of high frequency signals, and a result of a classification decision process of the high frequency band signals is received.

In Step 302, the high frequency signals are adaptively decoded according to the result of the classification decision process and a determined excitation signal.

In Step 303, output signals including the decoded low frequency signals and the adaptively decoded high frequency signals are obtained.

According to Embodiment 1, the high frequency signals are adaptively decoded according to the result of the classification decision process. In this way, different types of signals are adaptively decoded, so the quality of the output high frequency signals is improved.

Figure 7:
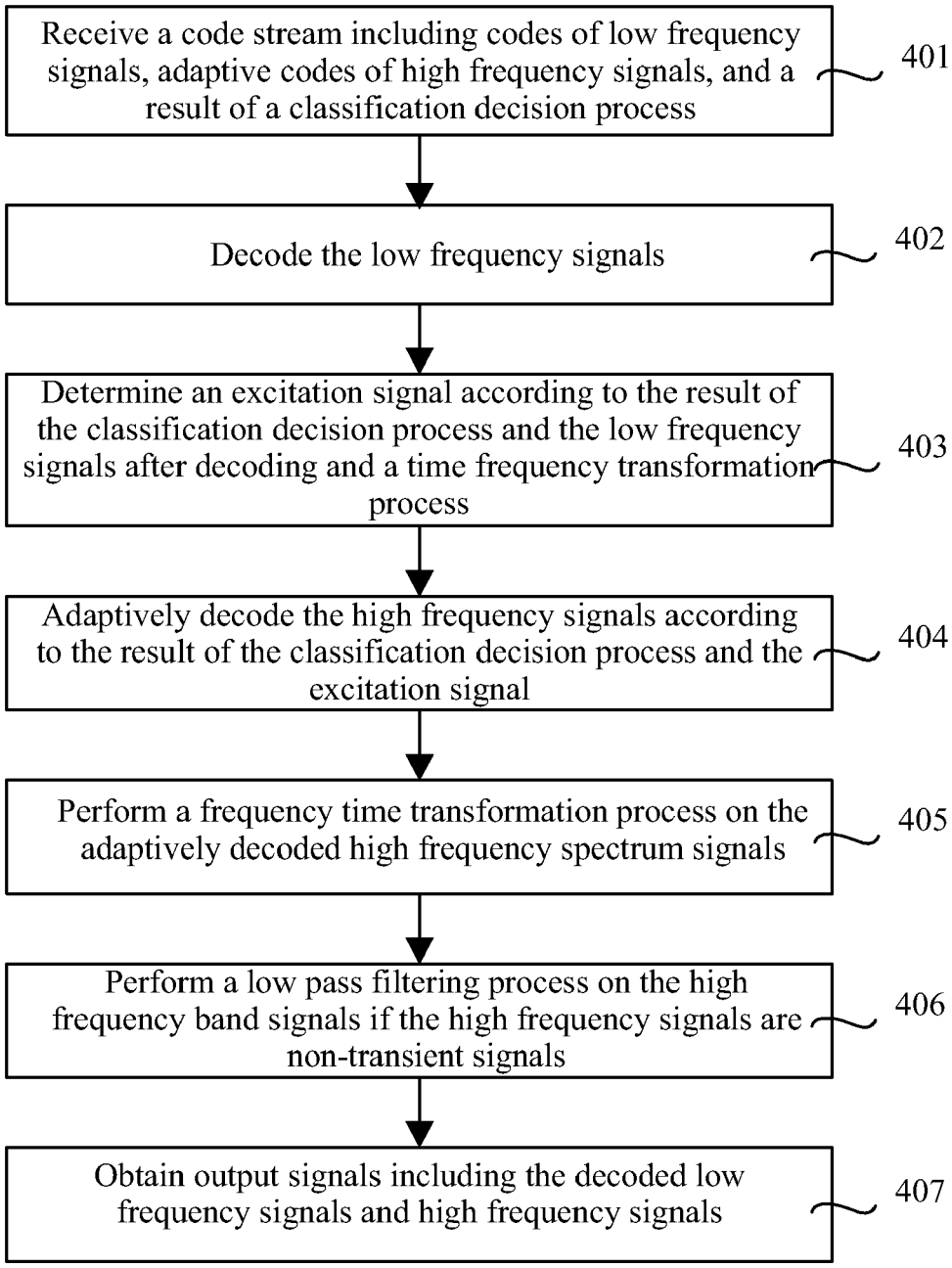
FIG. 7 is a flow chart of a method for decoding a signal according to Embodiment 2 of the present invention.

FIG. 7 is a flow chart of a method for decoding a signal according to Embodiment 2 of the present invention. As shown in FIG. 7, Embodiment 2 may correspond to the method for encoding a signal in Embodiment 2, and specifically includes the following steps.

In Step 401, a bitstream including an encoded bitstream of low frequency signals, an adaptive encoded bitstream of high frequency signals, and a result of a classification decision process is received.

In Step 402, the low frequency signals are decoded. The sequence for performing this step and the following steps 403 to 406 is not limited in Embodiment 2.

In Step 403, an excitation signal is determined according to the result of the classification decision process and the low frequency signals on which decoding and a time frequency transformation process are performed.

Specifically, the excitation signal is selected according to different types of the high frequency signals, so as to fully use the result of the signal classification decision to obtain higher reconstruction quality. For example, if the high frequency signals are transient signals, signals having broader frequency bands are selected as excitation signals, so as to better use a fine structure of a lower frequency. If the high frequency signals are harmonic signals, signals having broader frequency bands are selected as the excitation signals, so as to better use a fine structure of the low frequency. If the high frequency signals are noise-like signals, a random noise is selected as the excitation signal; and if the high frequency signals are ordinary signals, the low frequency signals are not selected as the excitation signals, so as to avoid generating too many harmonic waves at a high frequency.

In Step 404, the high frequency signals are adaptively decoded according to the result of the classification decision process, in which the result indicates the current frame type of the high frequency band signals, and the excitation signal.

This step may include allocating bits according to the current frame type of the high frequency signals, and adaptively decoding a time envelope and a spectral envelope of the current frame of the high frequency signals according to the selected excitation signal by using the allocated bits.

Figure 8:
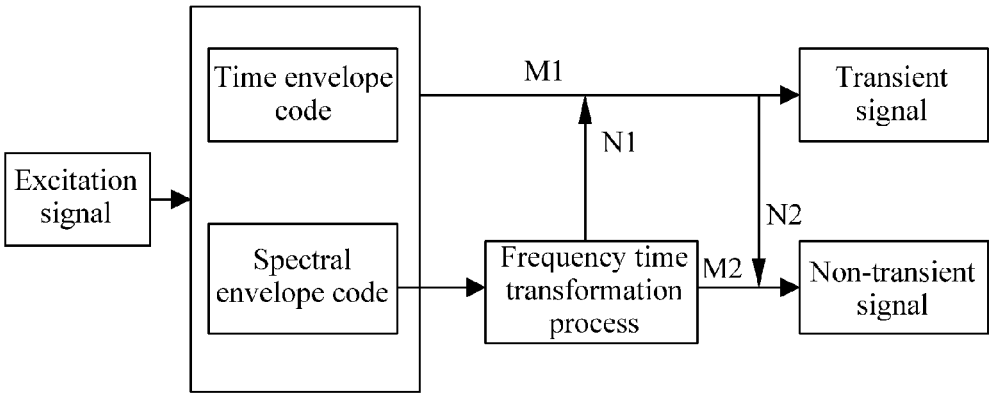
FIG. 8 is a schematic diagram of adaptive decoding in a method for decoding a signal according to Embodiment 2 of the present invention.

FIG. 8 is a schematic diagram of adaptive decoding in a method for decoding a signal according to Embodiment 2 of the present invention. Specifically, at a decoding end, values of M1 and N1, M2 and N2 may be preset. When the current frame type of the high frequency signals is the transient signal, the adaptive decoding is performed according to the bits allocated according to the values of M1 and N1. When the current frame type of the high frequency signals is the non-transient signal, the adaptive decoding is performed according to bits allocated according to the values of M2 and N2. Alternatively, the values of M1 and N1, or M2 and N2 are obtained from values carried in the bitstream, and then the time envelope and the spectral envelope of the high frequency signal are decoded according to the current frame type of the high frequency signal, so as to recover the high frequency signal.

In Step 405, a frequency time transformation process is performed on the adaptively decoded high frequency band spectrum signals.

In Step 406, if the high frequency signals are non-transient signals, a low pass filtering process is performed on the high frequency signals.

A low pass filter may be used to perform the low pass filtering process on the high frequency signal, and specifically, an expression of the low pass filter is:

$$\frac{1}{0.85 + 0.08z^{-1} + 0.05z^{-2} + 0.02z^{-3}}.$$

Through the low pass filtering process, energy of a low frequency part may be guaranteed, and energy of a high frequency part may be slightly reduced, so as to further reduce noise introduced because of errors.

In Step 407, output signals including the decoded low frequency signals and high frequency signals are obtained, and the decoded low frequency signals and high frequency signals are synthesized and output.

In Embodiment 2, the high frequency signals are adaptively decoded according to the result of the classification decision process. In this way, different types of signals are adaptively decoded, therefore, the quality of output high frequency signals is improved. Meanwhile, the excitation signal is selected according to the result of the classification decision process, so as to enable the high frequency signals obtained through decoding to be closer to the original high frequency signals before encoding, and to further improve the quality of the output high frequency signals.

Figure 9:
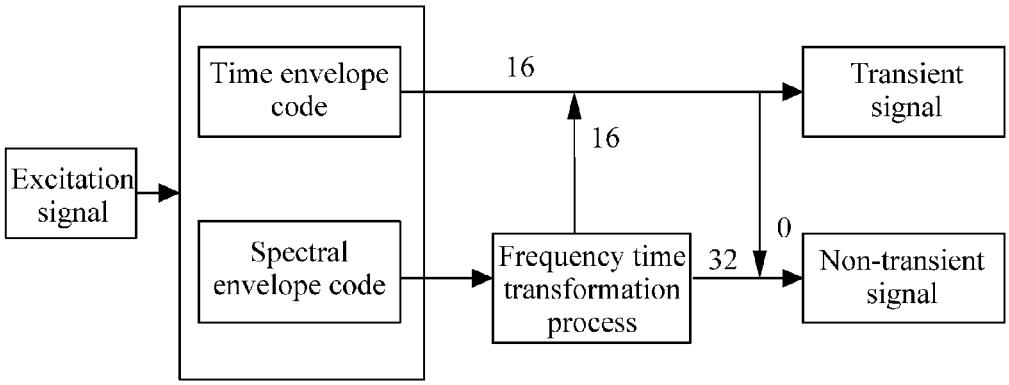
FIG. 9 is a schematic diagram of adaptive decoding in a method for decoding a signal according to Embodiment 3 of the present invention.

FIG. 9 is a schematic diagram of adaptive decoding in a method for decoding a signal according to Embodiment 3 of the present invention. As shown in FIG. 9, Embodiment 3 corresponds to the method for encoding a signal in Embodiment 3. At a decoding end, low frequency signals are decoded by using a G. 722 decoder to obtain wideband signals. Meanwhile, a result of a classification decision process is obtained from the bitstream, an excitation signal is selected according to the result of the classification decision process, and different excitation signals are used for different types of high frequency signals. According to the result of the classification decision process, values of M1=16, N1=16, or M2=32, N2=0 are selected to allocate bits, and a time envelope and a spectral envelope are decoded by using the allocated bits, so as to recover the high frequency signals.

Specifically, if the high frequency signals are transient signals, low frequency band spectrum signals of 0 kHz to 6 kHz are selected as the excitation signals, so as to better use a fine structure of a lower frequency. If the high frequency signals are harmonic signals, low frequency band spectrum signals of 0 kHz to 6 kHz are selected as the excitation signals, so as to better use a fine structure of a low frequency. If the high frequency signals are noise-like signals, a random noise is selected as the excitation signal; and if the high frequency signals are ordinary signals, low frequency signals of 3 kHz to 6 kHz are selected as spectrums for 8 kHz to 11 kHz and 11 kHz to 14 kHz to obtain the excitation signals, so as to avoid generating too many harmonic waves at a high frequency. The method for selecting the excitation signal is not limited in the embodiment of the present invention, and the excitation signal may be selected by using other methods.

Figure 10:
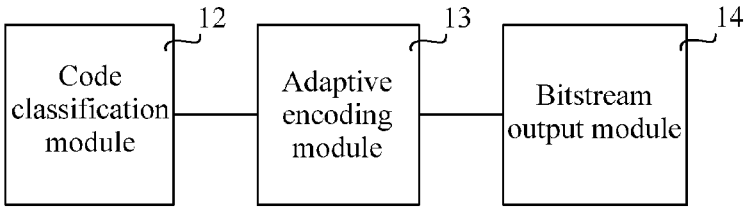
FIG. 10 is a schematic structural view of an apparatus for encoding a signal according to Embodiment 1 of the present invention.

FIG. 10 is a schematic structural view of an apparatus for encoding a signal according to Embodiment 1 of the present invention. As shown in FIG. 10, Embodiment 1 includes a code classification module 12, an adaptive encoding module 13, and bitstream output module 14. The code classification module 12 performs a classification decision process on high frequency signals of input signals. The adaptive encoding module 13 adaptively encodes the high frequency signals according to the result of the classification decision process.

The bitstream output module 14 outputs an encoded bitstream including an encoded bitstream of low frequency signals, an adaptive encoded bitstream of high frequency signals, and the result of the classification decision process.

Figure 11:
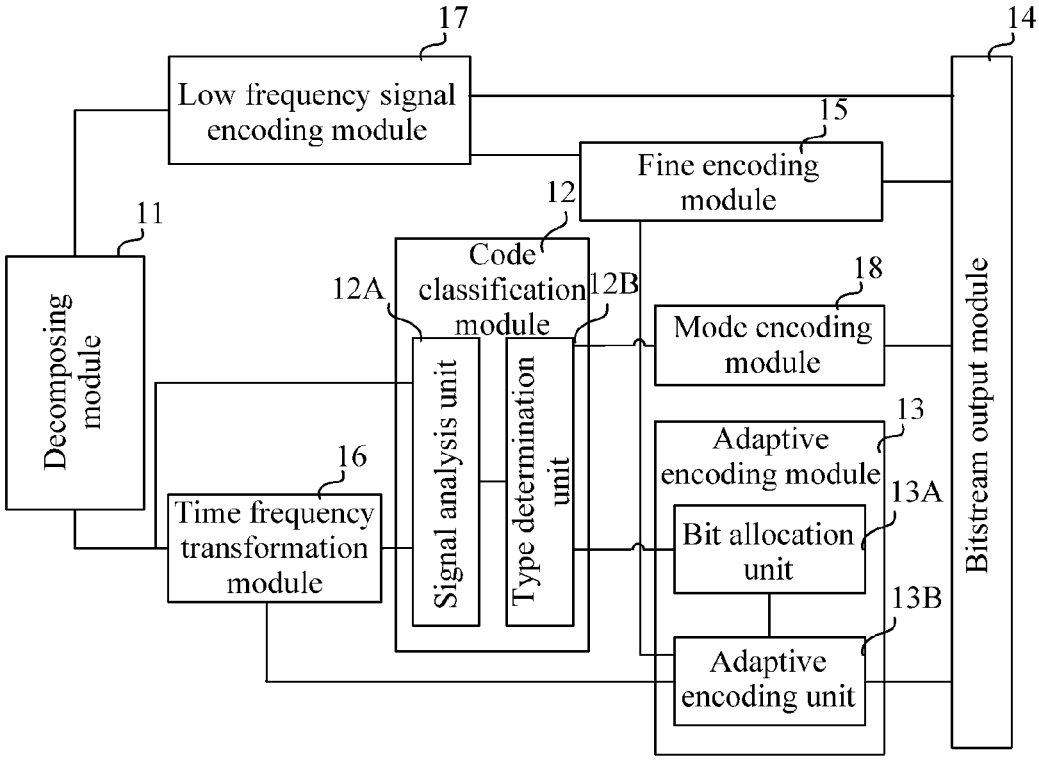
FIG. 11 is a schematic structural view of an apparatus for encoding a signal according to Embodiment 2 of the present invention.

FIG. 11 is a schematic structural view of an apparatus for encoding a signal according to Embodiment 2 of the present invention. As shown in FIG. 11, on the basis of Embodiment 1 as shown in FIG. 10, in Embodiment 2, the code classification module 12 may include a signal analysis unit 12A and a type determination unit 12B. The signal analysis unit 12A calculates parameters of high frequency signals. The type determination unit 12B determines a current frame type of the high frequency signals according to the calculated parameters and a decision mechanism.

The adaptive encoding module 13 may include a bit allocation unit 13A and an adaptive encoding unit 13B. The bit allocation unit 13A may allocate bits according to the current frame type of the high frequency signals. The adaptive encoding unit 13B adaptively encodes a time envelope and a spectral envelope of the current frame of the high frequency signals by using the allocated bits.

Embodiment 2 may include a decomposing module 11, and the decomposing module 11 decomposes the input signals to obtain low frequency signals and high frequency signals.

Embodiment 2 may further include a fine encoding module 15, and the fine encoding module 15 uses the remaining bits to perform fine quantizing encoding on the time envelope and/or the spectral envelope of the high frequency signals, or to perform fine quantizing encoding on the low frequency signals.

In addition, Embodiment 2 further includes a time frequency transformation module 16, a low frequency signal encoding module 17, and a mode encoding module 18. The time frequency transformation module 16 performs a time frequency transformation process on the decomposed high frequency signals. The low frequency signal encoding module 17 encodes the low frequency signals; specifically, the low frequency signal encoding module 17 may be the G. 722 encoder. The mode encoding module 18 encodes the result of the classification decision process.

Embodiment 2 is applicable to any process for encoding the signal in the method for encoding a signal in Embodiments 1 to 4.

In Embodiment 2, the code classification module 12 performs the classification decision process on high frequency signals, and the adaptive encoding module 13 performs adaptive encoding according to the result of the classification decision process. In this way, different types of signals are adaptively encoded, so the quality of voice and audio output signals is improved.

Figure 12:
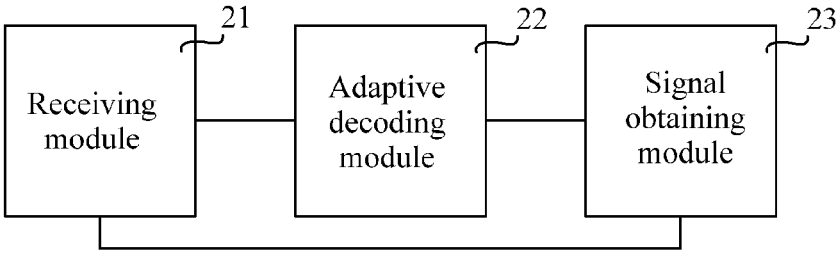
FIG. 12 is a schematic structural view of an apparatus for decoding a signal according to Embodiment 1 of the present invention.

FIG. 12 is a schematic structural view of an apparatus for decoding a signal according to Embodiment 1 of the present invention. As shown in FIG. 12, Embodiment 1 includes a receiving module 21, an adaptive decoding module 22, and a signal obtaining module 23. The receiving module 21 receives a bitstream including codes of low frequency signals, adaptive codes of high frequency signals, and a result of a classification decision process. The adaptive decoding module 22 adaptively decodes the high frequency signals according to the result of the classification decision process and a determined excitation signal. The signal obtaining module 23 obtains output signals including the decoded low frequency signals and the adaptively decoded high frequency signals.

Figure 13:
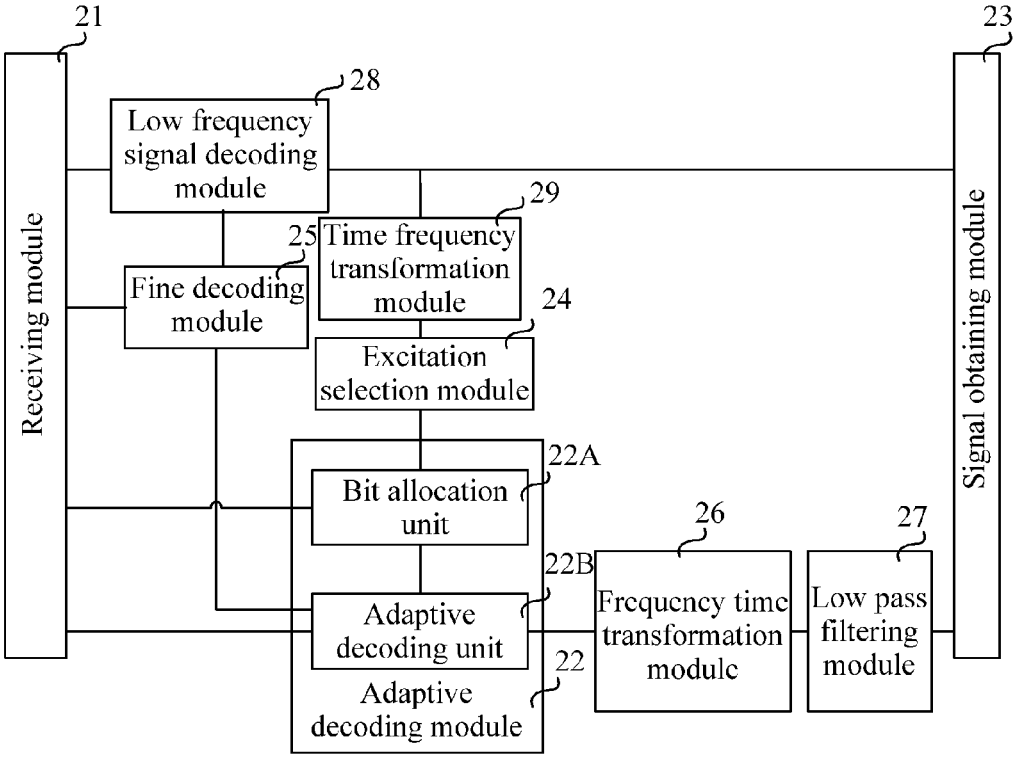
FIG. 13 is a schematic structural view of an apparatus for decoding a signal according to Embodiment 2 of the present invention.

FIG. 13 is a schematic structural view of an apparatus for decoding a signal according to Embodiment 2 of the present invention. As shown in FIG. 13, on the basis of Embodiment 1 as shown in FIG. 12, the adaptive decoding module 22 further includes a bit allocation unit 22A and an adaptive decoding unit 22B. The bit allocation unit 22A allocates bits according to a current frame type of high frequency signals. The adaptive decoding unit 22B adaptively decodes a time envelope and a spectral envelope of a current frame of the high frequency signals according to the selected excitation signal by using the allocated bits.

Furthermore, Embodiment 2 further includes an excitation selection module 24, and the excitation selection module 24 determines an excitation signal according to a result of a classification decision process and decoded low frequency signals.

Embodiment 2 may further include a fine decoding module 25, and the fine decoding module 25 uses the remaining bits to perform fine quantizing and decoding on the time envelope and/or the spectral envelope of the high frequency signals, or to perform fine quantizing and decoding on low frequency signals.

Embodiment 2 may further include a frequency time transformation module 26 and a low pass filtering module 27. The frequency time transformation module 26 performs a frequency time transformation process on the adaptively decoded high frequency spectrum signals. When the high frequency signals are non-transient signals, the low pass filtering module 27 performs a low pass filtering process on the high frequency signals after the frequency time transformation process.

In addition, Embodiment 2 further includes a low frequency signal decoding module 28 and a time frequency transformation module 29. The low frequency signal decoding module 28 decodes the low frequency signals. The time frequency transformation module 29 performs a time frequency transformation process on the low frequency signals.

Embodiment 2 is applicable to any process for decoding a signal in the method for decoding a signal in Embodiments 1 to 3

In Embodiment 2, the adaptive decoding module 22 adaptively decodes the high frequency signals according to the result of the classification decision process. In this way, different types of signals are adaptively decoded; therefore, the quality of the output high frequency signals is improved. The excitation selection module 24 selects the excitation signal according to the result of the classification decision process, and the excitation signal is adapted to adaptively decode the high frequency signals, so as to enable the high frequency signals obtained through decoding to be closer to the original high frequency signals before encoding, and to further improve the quality of the output high frequency signals. Furthermore, when the high frequency signals are non-transient signals, the low pass filtering module 27 performs the low pass filtering process, and energy of a low frequency part may be guaranteed, and meanwhile, energy of a high frequency part may be slightly reduced, so as to reduce noises introduced because of errors.

Figure 14:
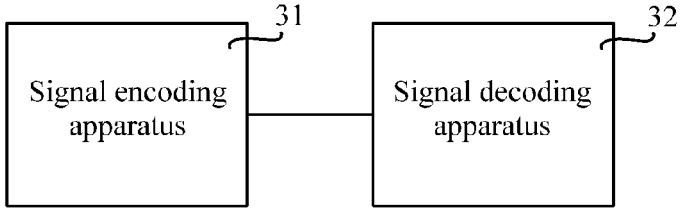
FIG. 14 is a schematic structural view of a system for encoding and decoding according to an embodiment of the present invention.

FIG. 14 is a schematic structural view of a system for encoding and decoding according to an embodiment of the present invention. As shown in FIG. 14, this embodiment includes a signal encoding apparatus 31 and a signal decoding apparatus 32.

The signal encoding apparatus 31 performs a classification decision process on high frequency signals of input signals, adaptively encodes the high frequency signals according to the result of the classification decision process, and outputs a bitstream including codes of low frequency signals of the input signals, the adaptive codes of the high frequency signals, and the result of the classification decision process.

The signal decoding apparatus 32 receives the bitstream including the codes of the low frequency signals, the adaptive codes of the high frequency signals, and the result of the classification decision process, adaptively decodes the high frequency signals according to the result of the classification decision process and a determined excitation signal, and obtains output signals including the decoded low frequency signals and the adaptively decoded high frequency signals.

In this embodiment, the signal encoding apparatus 31 may be any apparatus for encoding a signal in any embodiment of the present invention, and the signal decoding apparatus 32 may be any apparatus for decoding a signal in any embodiment of the present invention.

Persons of ordinary skill in the art should understand that all or a part of the steps of the method according to the embodiments of the present invention may be implemented by a program instructing relevant hardware. The program may be stored in a computer readable storage medium. When the program is run, the steps of the method according to the embodiments of the present invention are performed. The storage medium may be any medium that is capable of storing program codes, such as a read-only memory (ROM), a random access memory (RAM), a magnetic disk, and an optical disk.

Finally, it should be noted that the foregoing embodiments are merely provided for describing the technical solutions of the present invention, but are not intended to limit the present invention. It should be understood by persons of ordinary skill in the art that although the present invention has been described in detail with reference to the embodiments, modifications can be made to the technical solutions described in the embodiments, or equivalent replacements can be made to some technical features in the technical solutions, as long as such modifications or replacements do not depart from the spirit and scope of the present invention.

What is claimed is:

1. A method for encoding a signal, the method comprising:

performing a classification decision process on high frequency signals of input signals;

adaptively encoding the high frequency signals according to a result of the classification decision process, wherein the classification decision process is used to determine a type of the high frequency signals, wherein the type of the high frequency signals comprises a transient signal or a non-transient signal;

encoding low frequency signals of the input signals; and outputting an encoded bitstream of the low frequency signals, an adaptively encoded bitstream of the high frequency signals, and the result of the classification decision process wherein adaptively encoding the high frequency signals comprises:

encoding four time envelopes and four spectral envelopes for a transient signal; and encoding eight spectral envelopes for a non-transient signal, wherein no time envelope is encoded for the non-transient signal.

2. The method according to claim 1, wherein performing the classification decision process on the high frequency signals of the input signals comprises:

calculating parameters of the high frequency signals; and determining a current frame type of the high frequency signals according to the parameters and a decision mechanism.

3. The method according to claim 2, wherein the decision mechanism is dynamically adjusted according to a previous frame type of the high frequency signals and a weighted value of several previous frame types.

4. The method according to claim 2, wherein adaptively encoding the high frequency signals according to the result of the classification decision process comprises:

allocating bits according to the current frame type of the high frequency signals; and adaptively encoding a time envelope and a spectral envelope of the current frame of the high frequency signals by using the allocated bits.

5. The method according to claim 4, wherein:

if the current frame type of the high frequency signals is a transient signal, B1 represents all bits occupied by the transient signal, M1 represents bits occupied by the time envelope of the transient signal, N1 represents bits occupied by the spectral envelope of the transient signal, B1=M1+N1, and M1 is greater than or equal to N1; and if the current frame type of the high frequency signals is a non-transient signal, B2 represents all bits occupied by the non-transient signal, M2 represents bits occupied by the spectral envelope of the non-transient signal, N2 represents bits occupied by the time envelope of the non-transient signal, B2=M2+N2, and M2 is greater than or equal to N2.

6. The method according to claim 5, wherein B represents allocated bits, and B=B1=B2.

7. The method according to claim 5, wherein B represents allocated bits, B≧B1, and B≧B2.

8. The method according to claim 7, wherein:

a difference between B and B1 is used for performing fine quantizing encoding on the time envelope and/or the spectral envelope of the high frequency signals, or is used for performing fine quantizing encoding on the low frequency signals; and a difference between B and B2 is used for performing fine quantizing encoding on the spectral envelope and/or the time envelope of the high frequency signals, or is used for performing fine quantizing encoding on the low frequency signals.

9. A method for decoding a signal, the method comprising:

receiving an encoded bitstream of low frequency signals, an adaptive encoded bitstream of high frequency signals, and a result of a classification decision process;

adaptively decoding the high frequency signals according to the result of the classification decision process and a determined excitation signal, wherein the classification decision process is used to determine a type of the high frequency signals, wherein the type of the high frequency signals comprises a transient signal or a non-transient signal;

decoding the encoded bitstream of low frequency signals; and obtaining output signals comprising the decoded low frequency signals and the adaptively decoded high frequency signals wherein adaptively decoding the high frequency signals comprises:

decoding four time envelopes and four spectral envelopes for a transient signal determined based on an allocation of bits; and decoding eight spectral envelopes for a non-transient signal determined based on an allocation of bits, wherein no time envelope is decoded for the non-transient signal.

10. The method according to claim 9, wherein the result of the classification decision process comprises a current frame type of the high frequency signals, and the adaptively decoding the high frequency signals comprises:

allocating bits according to the current frame type of the high frequency signals; and adaptively decoding a time envelope and a spectral envelope of the current frame of the high frequency signals according to the determined excitation signal by using the allocated bits.

11. The method according to claim 10, further comprising:

determining the excitation signal according to the result of the classification decision process and the decoded low frequency signals.

12. The method according to claim 10, further comprising:

performing fine quantizing and decoding on the time envelope and/or the spectral envelope of the high frequency signals; or performing fine quantizing and decoding on the low frequency signals by using bits remaining after the allocation.

* * * * *